US010265876B2

(12) United States Patent
Konop et al.

(10) Patent No.: US 10,265,876 B2
(45) Date of Patent: Apr. 23, 2019

(54) MATERIAL CUTTER AND COMPRESSOR

(71) Applicants: Eric Konop, Ravensdale, WA (US); Sunny Konop, Ravensdale, WA (US)

(72) Inventors: Eric Konop, Ravensdale, WA (US); Sunny Konop, Ravensdale, WA (US)

( * ) Notice: Subject to any disclaimer, the term of this patent is extended or adjusted under 35 U.S.C. 154(b) by 25 days.

(21) Appl. No.: 15/633,745

(22) Filed: Jun. 26, 2017

(65) Prior Publication Data

US 2018/0194031 A1 Jul. 12, 2018

Related U.S. Application Data

(60) Provisional application No. 62/444,780, filed on Jan. 10, 2017.

(51) Int. Cl.
*B26D 7/02* (2006.01)
*B26B 29/06* (2006.01)

(52) U.S. Cl.
CPC ..... *B26D 7/025* (2013.01); *B26B 29/06* (2013.01)

(58) Field of Classification Search
CPC ..... B26D 7/025; B26B 29/06
USPC ..... 269/87.2
See application file for complete search history.

(56) References Cited

U.S. PATENT DOCUMENTS 231,857 A * 8/1880 Smith ..... B26D 7/025 83/455
2,661,046 A * 12/1953 Dain ..... C14B 9/00 156/502
2,790,498 A * 4/1957 Carscallen ..... B26D 1/045 83/383
3,199,860 A * 8/1965 Moberg ..... B26D 7/0006 269/87.2
3,576,148 A * 4/1971 Katz ..... B26B 29/06 269/87.2
4,354,410 A 10/1982 Stubbings
4,505,039 A * 3/1985 Donovan ..... B26B 29/06 269/295
5,086,680 A 2/1992 Johnson
8,656,819 B2 2/2014 Finnell
9,272,432 B1 3/2016 Brand et al.
9,636,835 B2 5/2017 Buss

* cited by examiner

*Primary Examiner* — George B Nguyen

(74) *Attorney, Agent, or Firm* — Christopher Mayle; John Houvener; Bold IP PLLC

(57) ABSTRACT

The present invention comprises a surface on which to place the insulation that is almost flush with the floor minimizing vertical displacement of the fiberglass. A hinged design allows a top member to compress the insulation. A machined slit provides a location for a cutting implement to be inserted and the insulation cut. Extending past the machined slit, the top portion provides a location where the user can rest his knee. Thus, an efficient cutting angle can be easily achieved and if needed more force can be used to further compress the insulation. A flange positioned at the end of the cutting slit protects the user's knee from the blade as well as any airborne insulation particles. It is also smaller than most other proposed solutions and so more easily stored and transported by a home owner or a professional from job site to job site.

11 Claims, 5 Drawing Sheets

MATERIAL CUTTER AND COMPRESSOR

CROSS-REFERENCE TO RELATED APPLICATIONS

This application claims priority to U.S. Provisional Application No. 62/444,780 filed Jan. 10, 2017. The content of the above application is incorporated by reference in its entirety.

FIELD OF THE DISCLOSURE

The overall field of the invention is material cutters and compressors.

BACKGROUND

At least 90% of the homes in the United States use fiberglass insulation to help keep hot air from entering the house in the summer or leaving the house in the winter. A man made material, fiberglass insulation helps keep energy costs down and limits environmental degradation from power generation. However, fiberglass insulation can also be dangerous. Even a brief brush of skin on fiberglass can cause immediate skin inflammation. Floating particles of insulation can inflame the eyes and make breathing difficult. Finally, prolonged inhalation of fiberglass particles can also cause cancer.

Fiberglass is generally easy to install, but unfortunately at some point during every insulation installation fiberglass will need to be cut on sight. The properties of fiberglass, such as its low density, that make it such a great insulator make cutting extremely difficult. Before a cutting utensil can be effectively drawn through the material, it must be compressed. The material can be compressed with a knee and then cut, but this exposes the installer's knee, arm, and hand to the cancer causing fiberglass. As well, to insure a straight cut a rule or other straight edge is usually used as a guide. This not only provides no protection for the installer from the knife it also allows fiberglass particles released when the fiberglass is cut into the air. The ability of the installer to keep the ruler or other straight edge positioned properly also determines the suitability of the cut. This can lead to different qualities of cut between different installers as well as different qualities even with the same installer at different times.

Several instrumentalities of different types have been developed to deal with the above problems but they all suffer from one or more deficiencies. U.S. Pat. No. 4,354,410 and the SkarBoard are mechanically complicated and certainly unsuitable for home if not professional users. U.S. Pat. Nos. 5,086,680, 8,656,819, and 7,404,351 provide no or only a minimal method of compressing the fiberglass, no or only moderate protection from skin irritation, and no or only the most minimal cutting guides. Finally U.S. Pat. No. 9,272,432 does not allow the user to easily and safely provide additional compressible force, and provides significantly less protection from skin irritation and particle inhalation than the current disclosure. U.S. Pat. No. 9,272,432 also teaching raising the insulation off the floor for cutting. Though this may keep the knife from scraping across a metal portion of the device, cutting location must be determined before the insulation is compressed by the device. As the insulation would drape downward over the edges of the device, inserting insulation into the device makes accurate measurement of length or width impossible.

All of the current solutions suffer from one or more of the problems described above.

SUMMARY

The present invention solves the above problems by providing a surface on which to place the insulation that is almost flush with the floor minimizing vertical displacement of the fiberglass. A hinged design allows a top member to compress the insulation. A machined slit provides a location for a cutting implement to be inserted and the insulation cut. Extending past the machined slit, the top portion provides a location where the user can rest his knee. Thus, an efficient cutting angle can be easily achieved and if needed more force can be used to further compress the insulation. A flange positioned at the end of the cutting slit protects the user's knee from the blade as well as any airborne insulation particles. It is also smaller than most other proposed solutions and so more easily stored and transported by a home owner or a professional from job site to job site.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure. Also, the drawings included herein are considered by the applicant to be informal.

DETAILED DESCRIPTION

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 400%. When, in this specification, a range is given as "(a first number) to (a second number)" or "(a first number)-(a second number)," this means a range whose limit is the second number. For example, 25 to 100 mm means a range whose lower limit is 25 mm and upper limit is 100 mm.

As used herein, the term "coupled" or "coupling" may indicate a connection. The connection may be a direct or an indirect connection between one or more items.

Figure 1:
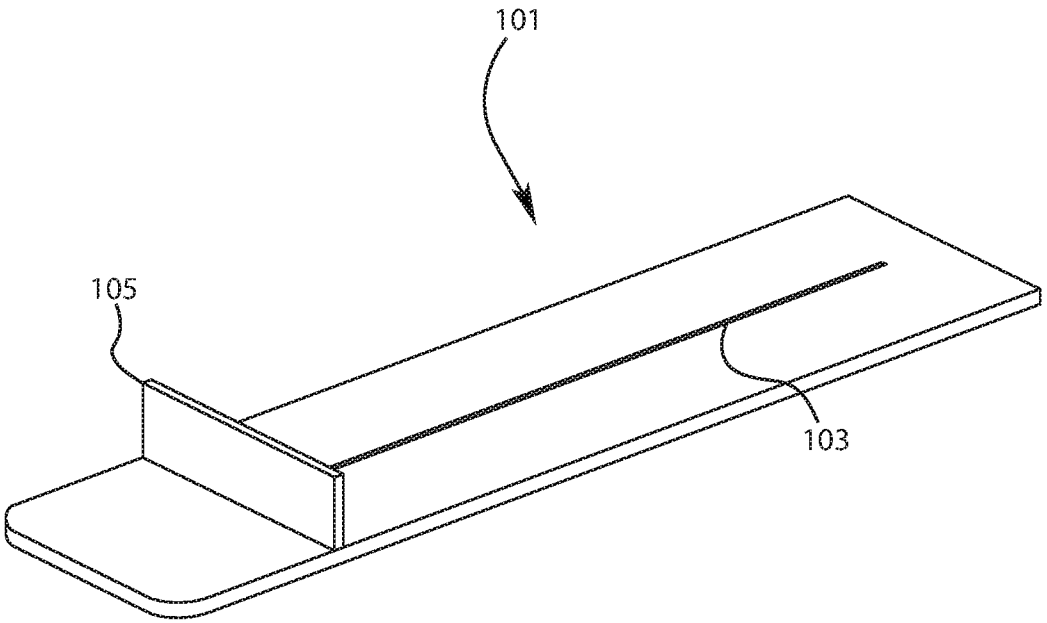
FIG. 1 is a perspective drawing of the Material Cutter and Compressor.

The Material Cutter and Compressor is a clamping apparatus that both compresses non-rigid material, like insulation, and provides a straight-line jig/template for cutting the non-rigid material. The apparatus comprises predominately metallic components, although hardened plastics, carbon fiber, fiberglass, or other lightweight materials common in the art could substitute for or supplement the metallic components. As can be seen in FIG. 1, the device consists of compression member 101, slit 103 capable of accepting a cutting implement, and vertical member 105. In one embodiment, slit 103 capable of accepting a cutting implement extends parallel to compression member 101 from vertical member 105 toward an end of compression member 101. In one embodiment, slit 103 capable of accepting a cutting implement sits generally in the middle of compression member 101, is at least 0.1 inch wide, and extends parallel to the compression member. In alternative embodiments as would be obvious to one of ordinary skill in the art, slit 103 capable of accepting a cutting implement could extend generally perpendicular to compression member 101 as well as starting and ending at various points on compression member 101.

Figure 2:
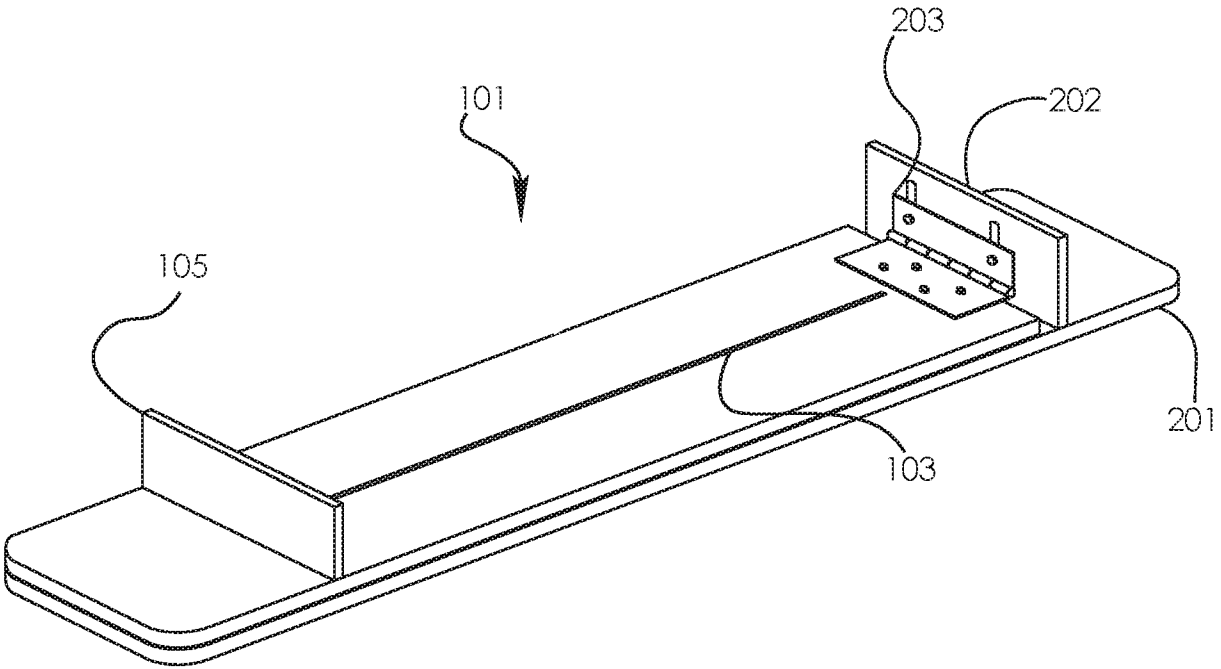
FIG. 2 is perspective drawing of an alternate embodiment of the Material Cutter and Compressor.
Figure 3:
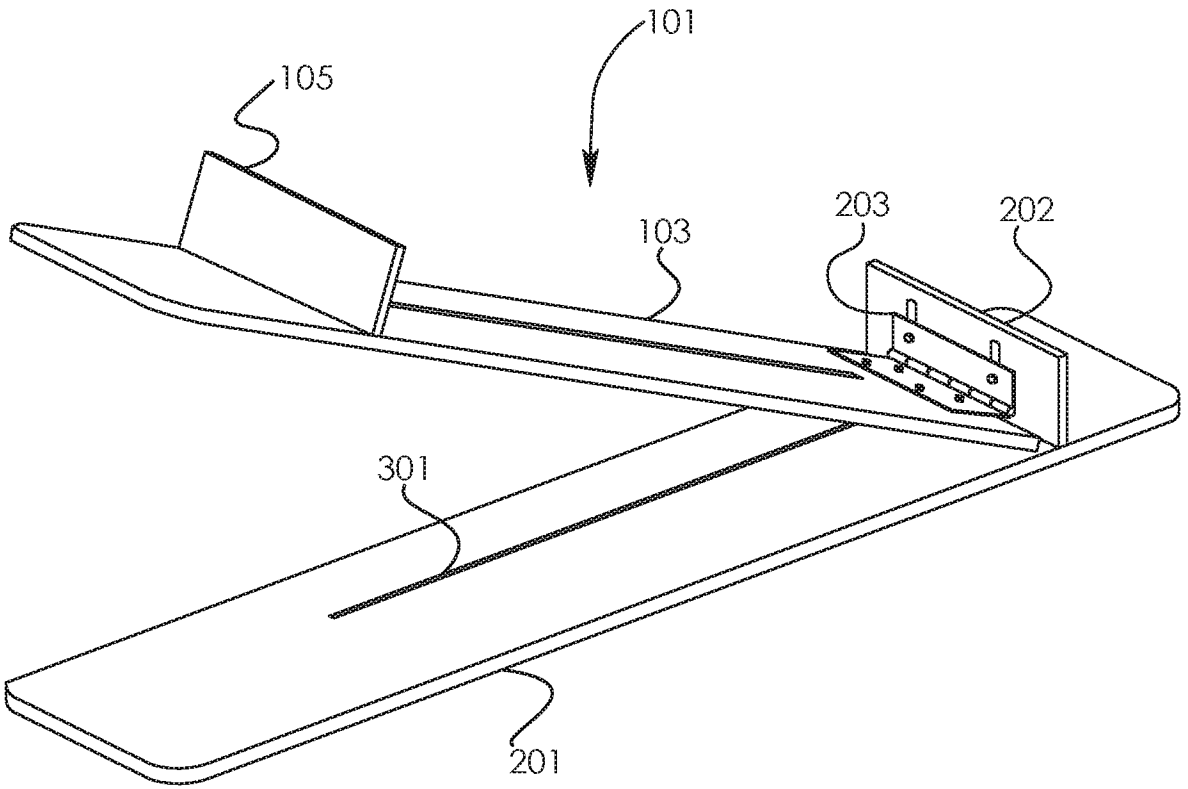
FIG. 3 is a perspective drawing of an alternate embodiment of the Material Cutter and Compressor in an open configuration.

FIG. 2 shows an alternative embodiment of the device where bottom member 201 is attached to compression member 101 by hinge 203. In the embodiment shown, hinge 203 is attached to vertical member 202 which is coupled to bottom member 201. As shown in FIG. 3, vertical member 105 allows compression member 101 to be lifted from bottom member 201. As also shown in FIG. 3, a plastic or other protective piece 301 can be coupled to bottom member 201. In one embodiment, bottom member 201 extends at least 5" past hinge 203, vertical member 105 is at least 5" from the end of compression member 101 opposite hinge 203, and hinge 203 is at least 23" from vertical member 105. As would be obvious to one of ordinary skill in the art, the exact placement of these components can vary without materially affecting the operation of the device. In the accompanying figures, vertical member 105 is shown as rectangular and solid, but solid or partially hollow ovoid or circular shapes are also possible.

Figure 4:
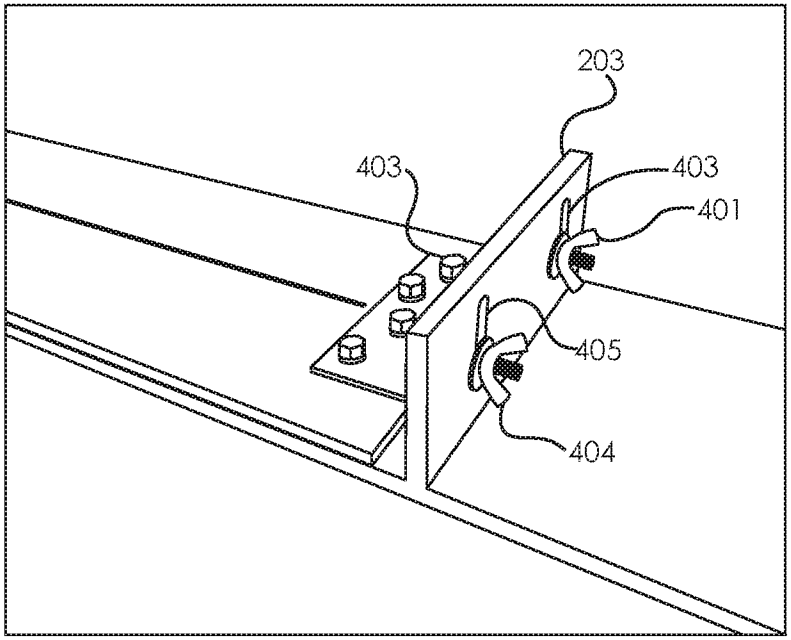
FIG. 4. is a close up drawing of the hinge and wing nut mechanism of the Material Cutter and Compressor.

As best seen in FIG. 4, one embodiment of hinge 203 comprises wing nut mechanism 401 and bolt mechanism 403. In one embodiment, wing nut mechanism 401 comprises at least 2 wing nuts and studs 404 coupled to vertical member 202 in slits 405. Since wing nuts and studs 404 can slide in slits 405, compression member 101 can be raised to various heights above bottom member 201. One embodiment of bolt mechanism 403 comprises a plurality of tapered bolts coupled to the underside of compression member 101. It should be noted that bolt mechanism 403 could be replaced by any fastening means common in the art including but not limited to screws or clamps.

Figure 5:
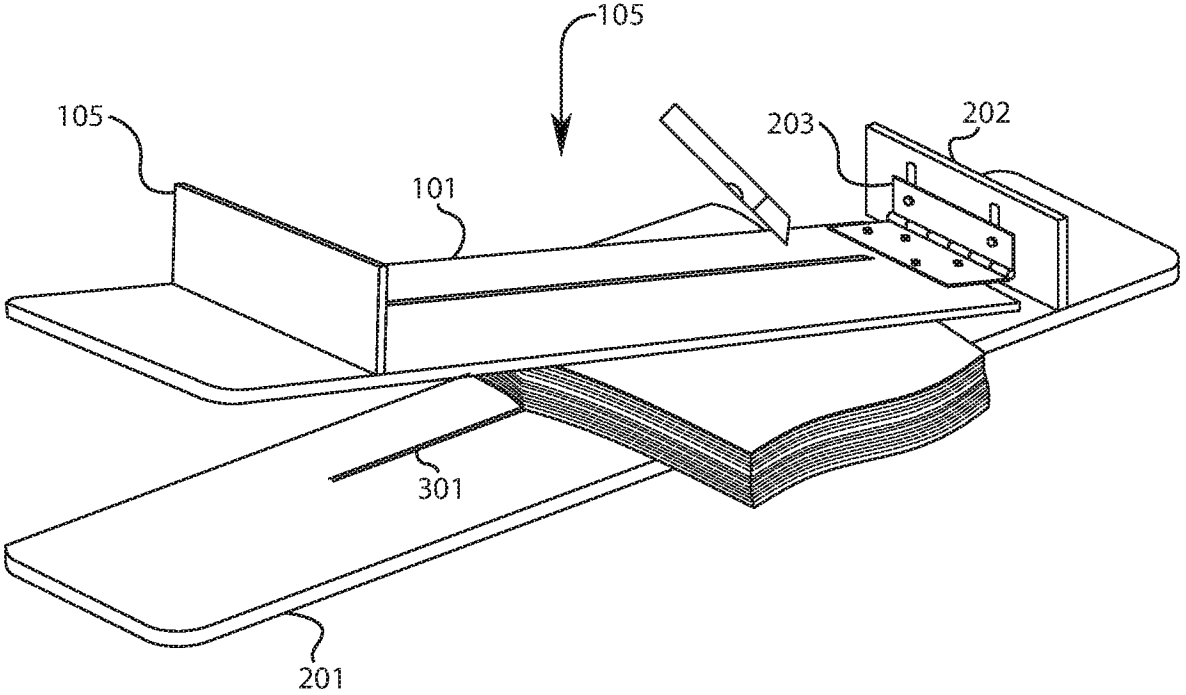
FIG. 5 is a perspective drawing of the Material Cutter and Compressor in use.

In use: (1) compression member 101 would be placed over the material to be cut, (2) one or both of the user's knees would be placed on the side of vertical member 105 opposite slit 103 capable of accepting a cutting implement and (3) a cutting implement would be placed through slit 103 to cut the material. If bottom member 201 is present as seen in FIG. 5: (1) it would be lifted using vertical member 105 and the material to be cut placed between bottom member 201 and compression member 101, (2) wing nut mechanism 401 would be adjusted if necessary, (3) one or both of the user's knees would be placed on the side of vertical member 105 opposite slit 103 capable of accepting a cutting implement, and (4) a cutting implement would be placed through slit 103 to cut the material. To cut particularly soft or dangerous material, one individual could place one or both of their knees on the side of vertical member 105 away from slit 103 capable of accepting a cutting implement while another individual cut the material from behind vertical member 202. Alternatively, the individual behind vertical member 105 could cut part of the material while the individual behind vertical member 202 cut the rest. This would allow equal or increased compressive force on the material while providing more protection for both users.

The Material Cutter and Compressor could be made of aluminum, any other metal, or a heavy duty plastic. If the rest of the apparatus is made out of plastic, hinge 203 could either still be made out of metal or made out of plastic but with supports running down the center of hinge 203.

While preferred and alternate embodiments have been illustrated and described, as noted above, many changes can be made without departing from the spirit and scope of Material Cutter and Compressor. Accordingly, the scope of the Material Cutter and Compressor is not limited by the disclosure of these preferred and alternate embodiments. Instead, the scope of the Material Cutter and Compressor is to be determined entirely by reference to the claims. Insofar as the description above and the accompanying drawings (if any) disclose any additional subject matter that is not within the scope of the claims below, the inventions are not dedicated to the public and Applicant hereby reserves the right to file one or more applications to claim such additional inventions.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example of a generic series of equivalent or similar features.

Any element in a claim that does not explicitly state "means for" performing a specified function, or "step for" performing a specific function is not to be interpreted as a "means" or "step" clause as specified in 35. U.S.C. § 112 ¶ 6. In particular, the use of"step of" in the claims herein is not intended to invoke the provisions of U.S.C. § 112 ¶ 6.

The invention claimed is:

1. A material compressor and cutter device comprising:

a compression member with a first and second end;

a protective member coupled to and extending perpendicularly away from the compression member and positioned between the compression member's first and second end; and a slit in the compression member capable of accepting a cutting implement;

wherein the protective member is closer to the compression member's first rather than its second end;

wherein the slit begins after the protective member and ends before the compression member's second end.

2. The material compressor and cutter of claim 1 wherein the slit begins after the protective member and extends through and parallel to the compression member toward the compression member's second end.

3. A material compressor and cutter device comprising:

a compression member with a first and second end;

a protective member coupled to and extending perpendicularly away from the compression member and positioned between the compression member's first and second end;

a slit in the compression member capable of accepting a cutting implement; and a bottom member coupled to the compression member such that material placed between the bottom member and the compression member lies substantially flat;

wherein the bottom member extends past the compression member.

4. The material compressor and cutter of claim 3 further comprising a cutting prevention member coupled to the bottom member and placed underneath the slit in the compression member.

5. The material compressor and cutter of claim 3 wherein the protective member is closer to the compression member's first rather than its second end.

6. The material compressor and cutter of claim 5 wherein the slit begins after the protective member and ends before the compression member's second end.

7. The material compressor and cutter of claim 6 wherein the slit begins after the protective member and extends through and parallel to the compression member toward the compression member's second end.

8. A material compressor and cutter device comprising:

a compression member with a first and second end;

a protective member coupled to and extending perpendicularly away from the compression member and positioned between the compression member's first and second end;

a slit in the compression member capable of accepting a cutting implement; and a bottom member coupled to the compression member such that material placed between the bottom member and the compression member lies substantially flat;

wherein a hinge connects the bottom member to the compression member.

9. The material compressor and cutter of claim 8 wherein the hinge further comprises at least two wing nuts and two studs.

10. The material compressor and cutter of claim 8 wherein the hinge further comprises at least one tapered bolt on the underside of the compression member.

11. The material compressor and cutter of claim 8 wherein the compression member, the bottom member, the protective member, and the hinge are all made of plastic and wherein the hinge further comprises supports.

* * * * *